US007760179B2

(12) United States Patent
Lee

(10) Patent No.: US 7,760,179 B2
(45) Date of Patent: Jul. 20, 2010

(54) LIQUID CRYSTAL PANEL HAVING THE DUAL DATA LINES, DATA DRIVER, LIQUID CRYSTAL DISPLAY DEVICE HAVING THE SAME AND DRIVING METHOD THEREOF

(75) Inventor: Ju Young Lee, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 783 days.

(21) Appl. No.: 11/638,390

(22) Filed: Dec. 14, 2006

(65) Prior Publication Data

US 2008/0001901 A1 Jan. 3, 2008

(30) Foreign Application Priority Data

Jun. 29, 2006 (KR) ..... 10-2006-0059214

(51) Int. Cl.
*G09G 3/36* (2006.01)

(52) U.S. Cl. ..... 345/98

(58) Field of Classification Search ..... 345/87–100, 345/204–206; 349/38–48, 141–143
See application file for complete search history.

(56) References Cited

U.S. PATENT DOCUMENTS 4,930,874 A * 6/1990 Mitsumune et al. ..... 349/48
5,333,004 A * 7/1994 Mourey et al. ..... 345/92
5,701,166 A * 12/1997 Fedorovish et al. ..... 349/38
5,712,652 A * 1/1998 Sato et al. ..... 345/90
5,959,599 A * 9/1999 Hirakata ..... 345/92
6,243,064 B1 * 6/2001 Hirakata ..... 345/96
6,456,269 B2 * 9/2002 Hirakata ..... 345/92
6,525,710 B1 * 2/2003 Kwon ..... 345/100
6,566,643 B2 * 5/2003 Morita ..... 250/208.1
7,027,023 B2 * 4/2006 Okishiro et al. ..... 345/94
7,375,712 B2 * 5/2008 Sasaki ..... 345/96
7,425,940 B2 * 9/2008 Kawachi ..... 345/98
7,486,362 B2 * 2/2009 Park ..... 349/141
2001/0050664 A1 * 12/2001 Yamazaki et al. ..... 345/76
2003/0002002 A1 * 1/2003 Kawachi et al. ..... 349/143
2003/0169379 A1 * 9/2003 Tsumura et al. ..... 349/42
2004/0104880 A1 * 6/2004 Kang et al. ..... 345/94
2005/0046763 A1 * 3/2005 Ono et al. ..... 349/39
2007/0296658 A1 * 12/2007 Kim ..... 345/87

* cited by examiner

*Primary Examiner*—Sumati Lefkowitz
*Assistant Examiner*—Rodney Amadiz
(74) *Attorney, Agent, or Firm*—McKenna Long & Aldridge LLP

(57) ABSTRACT

A liquid crystal display panel includes a plurality of gate lines; a plurality of first data lines and a plurality of second data lines crossing the gate lines; and a plurality of pixels defined by crossings of a plurality of gate lines with a plurality of first data lines and a plurality of second data lines, wherein each of the pixels includes: a first thin film transistor connected to a gate line and one of the first data line; a second thin film transistor connected to one of the gate lines and one of the second data lines; and a liquid crystal cell connected to the first and second thin film transistors that drive the liquid crystal cell using a potential difference between first and second data voltages supplied to the one of the first data lines and the one of the second data lines.

23 Claims, 7 Drawing Sheets

LIQUID CRYSTAL PANEL HAVING THE DUAL DATA LINES, DATA DRIVER, LIQUID CRYSTAL DISPLAY DEVICE HAVING THE SAME AND DRIVING METHOD THEREOF

This application claims the benefit of Korean Patent Application No. 10-2006-0059214, filed on Jun. 29, 2006, which is hereby incorporated by reference for all purposes as if fully set forth herein.

BACKGROUND OF THE INVENTION

1. Field of the Invention

The present invention relates to a liquid crystal display (LCD) device, and more particularly, to a liquid crystal display panel, a data driver, an LCD device using the same, and a driving method for an LCD device.

2. Discussion of the Related Art

With the rise of an information society the demand for display devices has increased. To meet the demand, various types of display devices including liquid crystal display (LCD) devices, plasma display panels (PDP), electro luminescent devices (ELD), and vacuum fluorescent displays (VFD). Some of these devices are currently in use as display devices.

Among the various types of display devices, the LCD device has been widely used because of advantages including excellent image quality, light weight, compact profile, and low power consumption. Accordingly, the LCD device has been in various applications including as a monitor for a portable apparatuses and as a display panel for televisions.

In the typical LCD device, data are respectively supplied to a matrix of pixels, and a desired image can be displayed by controlling the light transmittances of the pixels.

FIG. 1 is a block diagram of a related art LCD device. FIG. 2 is a circuit diagram illustrating a liquid crystal display panel of FIG. 1, and FIG. 3 is a block diagram illustrating a data driver of the liquid crystal display panel of FIG. 1.

Referring to FIG. 1, the related art LCD device includes a liquid crystal display panel 9, a gate driver 3, a gamma generator 7, a data driver 5, a common voltage generator 8, and a timing controller 1. The liquid crystal display panel 9 includes a plurality of pixels arranged in a matrix. The gate driver 3 supplies a scan signal to the liquid crystal display panel 9. The data driver 5 supplies a data voltage based on the gamma voltage corresponding to R, G and B data signals forming an image to the liquid crystal display panel 9. The common voltage generator 8 generates a common voltage Vcom to be applied to the liquid crystal display panel 9. The timing controller 1 generates a control signal for controlling the gate driver 3 and the data driver 5.

The liquid crystal display panel 9 may have various structures depending upon the mode of operation of the liquid crystal display panel 9. The liquid crystal display panel of FIG. 2 operates in an in-plane switching (IPS) mode.

Referring to FIG. 2, a plurality of gate lines G1 to Gn and a plurality of data lines D1 to Dm are arranged on the liquid crystal display panel 9 such that the plurality of gate lines G1 to Gn cross the plurality of data lines D1 to Dm. A plurality of pixels P is defined by crossings of the plurality of gate lines G1 to Gn with the plurality of data lines D1 to Dm. Each pixel P includes a thin film transistor (TFT) connected to a gate line G1 to Gn and the data line D1 to Dm, and a pixel electrode (not shown) connected to the TFT. Although not shown, the pixel P also includes a common electrode branched from the common line VL1 to VLn.

A data voltage is applied to the pixel electrode, and a common voltage Vcom is applied to the common electrode resulting in a potential difference (i.e., voltage difference) between the data voltage and the common voltage Vcom applied to the pixel electrode and the common electrode. Molecules of a liquid crystal layer existing between the pixel electrode and the common electrode are driven by means of the potential difference. Liquid crystal cells represented as capacitors (Clc) are formed by the liquid crystal molecules of each pixel. Although not shown, a storage capacitor for maintaining the data voltage applied to the pixel for one frame (or one frame period) may be formed between the gate line G1 to Gn and the pixel electrode.

The timing controller 1 generates a control signal for driving the liquid crystal display panel 9 using image data and synchronization signal input from an external source such as an external video card. The control signal includes a first control signal that controls the gate driver 3, and a second control signal that controls the data driver 5. The first control signal includes a gate shift clock (GSC), a gate start pulse (GSP), and a gate output enable (GOE) signal. The second control signal includes source shift clock (SSC), source start pulse (SSP), source output enable (SOE) signal, and a polarity control (POL) signal.

The gate driver 3 sequentially supplies the scan signals to the respective gate lines G1 to Gn in response to the first control signal supplied from the timing controller 1. Accordingly, each of the respective gate lines G1 to Gn of the liquid crystal display panel 9 is activated in sequence. By activation it is meant that the TFTs connected to a respective gate lines G1 to Gn are turned on by the scan signal. When the TFTs are turned on, the data voltage supplied from the data driver 5 is supplied to the pixel electrode via the TFT connected to the activated gate line.

Referring to FIG. 3, the data driver 5 includes a data latch unit 13, a shift register 12, a line latch unit 14, a digital to analog (DA) converter 16, and an output buffer unit 17.

The data latch unit 13 latches n-bit R, G and B data signals supplied from the timing controller 1 in units of pixels. The shift register 12 sequentially generates the latch enable signals that control the line latch unit 14 to latch the R, G and B data signals latched in the data latch unit 13 in synchronization with the SSC signal, when the SSP signal is applied to the shift register 12. In response to the latch enable signals that are sequentially generated at the shift register 12, the R, G and B data signals latched in the data latch unit 13 are latched in the line latch unit 14 in sequence. For example, the R, G and B data signals are simultaneously latched in the line latch unit 14 in response to a first latch enable signal output from the shift register 12. Similarly, the R, G and B data signals are simultaneously latched in the line latch unit 14 in response to a second latch enable signal output from the shift register 12. Through a sequence of such operations, the line latch unit 14 latches a volume of data corresponding to one horizontal display line.

The line latch unit 14 can latch the data signals corresponding to a preset number of channels. As illustrated in FIG. 3, the line latch 14 can latch the data signals corresponding to 192 channels OUT1 to OUT192.

For example, when the number of the data lines of the liquid crystal display panel 9 is 576, the number of channels of the data driver 5 corresponding to the respective data lines should also be 576. However, since the number of channels for a data driver IC is 192 in the data driver 5 of FIG. 3, the data driver 5 can provide 576 channels by including three data driver ICs each having 192 channels.

The DA converter 16 converts the R, G and B data signals latched at the line latch unit 14 into R, G and B data voltages corresponding to a gamma voltage supplied from the gamma generator 7. The DA converter 16 may generate the R, G and B data voltages using one of a positive polarity gamma voltage and a negative polarity gamma voltage supplied from the gamma generator 7.

The output buffer unit 17 outputs the R, G and B data voltages to the respective channels OUT1 to OUT192 in response to the SOE signal. Each channel is connected to a respective data line of the liquid crystal display panel 9.

By using the data driver of the above-described configuration, the related art LCD device may alternately supply a data voltage based on the positive polarity gamma voltage and the data voltage based on the negative polarity gamma voltage to operate the related art LCD in an inversion mode.

However, the related art LCD device includes a plurality of common lines corresponding to the number of gate lines in the liquid crystal display panel 9. Because a pixel includes one or more common lines as well as the gate and data lines, the overall aperture ratio of the related art LCD device is decreased.

In addition, the related art LCD device has an inherent limitation affecting the voltage difference between the voltages for driving liquid crystals, i.e., the voltage difference between the data voltage and the common voltage. Because the common voltage is typically set to half of the data voltage, the potential difference between the common voltage and the data voltage is limited and increasing the data voltage produces only a limited increase in the potential difference. Accordingly, a limit is encountered when attempting to increase the potential difference to obtain a high brightness level to enhance the image quality of the display.

Moreover, the limitation on the potential difference between the data voltage and the common voltage limits improving a response speed of the liquid crystal by operating the display with an increased potential difference Furthermore, because the related art LCD device requires a common line and circuitry for generating the common voltage to be supplied to the common line, problems including a complicated fabrication process, high fabrication cost, and low aperture ratio are created.

SUMMARY OF THE INVENTION

Accordingly, the present invention is directed to a liquid crystal display panel, a data driver, a liquid crystal display device having the same and a driving method thereof that substantially obviates one or more problems due to limitations and disadvantages of the related art.

An advantage of the present invention is to provide a liquid crystal display panel, a data driver, an LCD device having the same, and a driving method thereof, which can be driven with high voltage.

Another advantage of the present invention is to provide a liquid crystal display panel, a data driver, an LCD device having the same, and a driving method thereof, which can provide an image having high brightness.

Another advantage of the present invention is to provide a liquid crystal display panel, a data driver, an LCD device having the same, and a driving method thereof, which can improve an image quality by increasing a response speed of a liquid crystal.

And still another advantage of the present invention to provide a liquid crystal display panel, a data driver, an LCD device having the same, and a driving method thereof, which can provide a simple fabrication process, a low fabrication cost and an improved aperture ratio because there is not required an apparatus for generating a common voltage.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described herein, a liquid crystal display panel includes: a plurality of gate lines; a plurality of first data lines and a plurality of second data lines crossing the gate lines; and a plurality of pixels defined by crossings of a plurality of gate lines with a plurality of first data lines and a plurality of second data lines, wherein each of the pixels includes: a first thin film transistor connected to a gate line and one of the first data line; a second thin film transistor connected to one of the gate lines and one of the second data lines; and a liquid crystal cell connected to the first and second thin film transistors that drive the liquid crystal cell using a potential difference between first and second data voltages supplied to the one of the first data lines and the one of the second data lines.

In another aspect of the present invention, there is provided a data driver for driving a liquid crystal display panel including a plurality of gate lines, a plurality of first data lines and a plurality of second data lines crossing the gate lines, and a plurality of pixels defined by crossings of a plurality of gate lines with a plurality of first data lines and a plurality of second data lines, wherein each of the pixels includes a first thin film transistor connected to the gate line and the first data line, a second thin film transistor connected to the gate line and the second data line, and a liquid crystal cell connected between the first and second thin film transistors, wherein the data driver includes: a division unit that divides an input data signal into first and second data signals; a shift register that sequentially outputs a latch enable signal; a latch unit that latches the divided first and second data signals in response to the latch enable signal; and a digital to analog converter that outputs first and second data voltages corresponding to the first and second data signals using a plurality of positive polarity gamma voltages and a plurality of negative polarity gamma voltages, wherein a voltage level of each first data voltage is symmetric to that of a respective second data voltage with respect to a reference voltage.

In another aspect of the present invention, there is provided a data driver for driving a liquid crystal display panel including a plurality of gate lines, a plurality of first data lines and a plurality of second data lines crossing the gate lines, and a plurality of pixels defined by crossings of a plurality of gate lines with a plurality of first data lines and a plurality of second data lines, wherein each of the pixels includes: a first thin film transistor connected to the gate line and the first data line, a second thin film transistor connected to the gate line and the second data line, and a liquid crystal cell connected between the first and second thin film transistors, the data driver including: a shift register that sequentially outputs a latch enable signal; a latch unit that latches an input data signal in response to the latch enable signal; a division unit that divides the input data signal into first and second data signals; and a digital to analog converter that outputs first and second data voltages corresponding to the first and second data signals using a plurality of positive polarity gamma voltages and a plurality of negative polarity gamma voltages, wherein a voltage level of each first data voltage is symmetric to a voltage level of the respective second data voltage with respect to a reference voltage.

In still another aspect of the present invention, there is provided a liquid crystal display device including: a liquid crystal display panel including a plurality of pixels arranged in a matrix, wherein each pixel is defined by an crossing of a gate line with a first data line and a second data line; a gate driver supplying a scan signal that activates the gate line; and a data driver that supplies first and second data voltages to the first and second data lines using first and second data signals, wherein the first and second data voltage are different from each other, a voltage level of the first data voltage being symmetric to that of the second data voltage with respect to a reference voltage.

In yet another aspect of the present invention, there is provided a method of driving a liquid crystal display device including a driving unit for driving a liquid crystal display panel having a plurality of pixels arranged in a matrix, wherein each pixel is defined by an crossing of a gate line with a first data line and a second data line, the method including: supplying a scan signal for activating the gate line; supplying first and second data voltages to the first and second data lines, wherein the first and second data voltage are different from each other; and displaying an image on the liquid crystal display panel using potential difference between the first and second data voltages, wherein a voltage level of the first data voltage is symmetric to that of the second data voltage with respect to a reference voltage.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
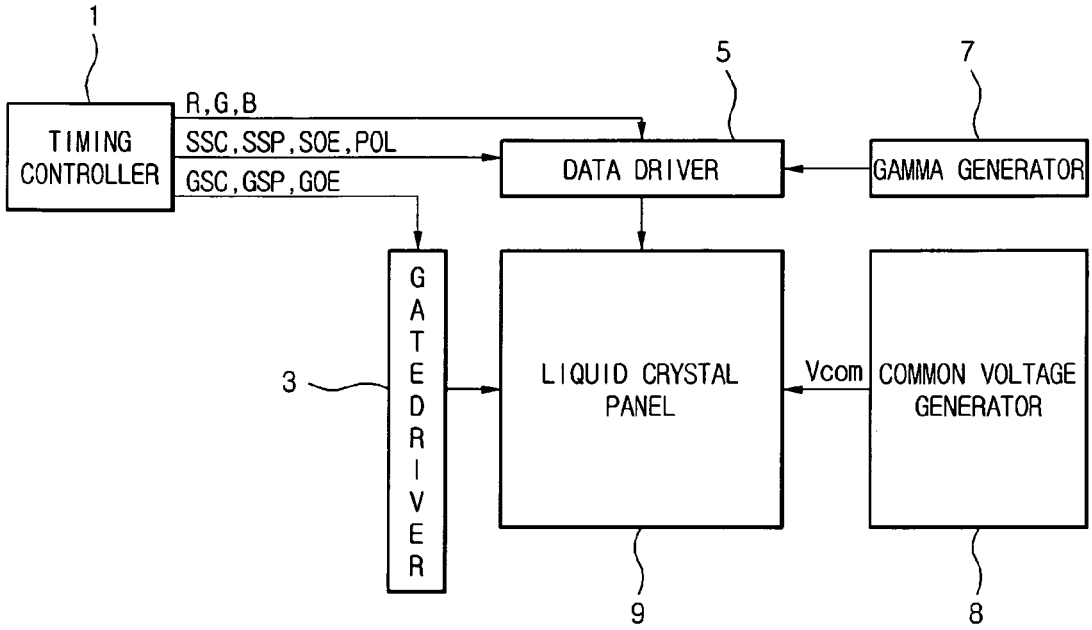
FIG. 1 is a block diagram of a related art liquid crystal display device (LCD) device.
Figure 2:
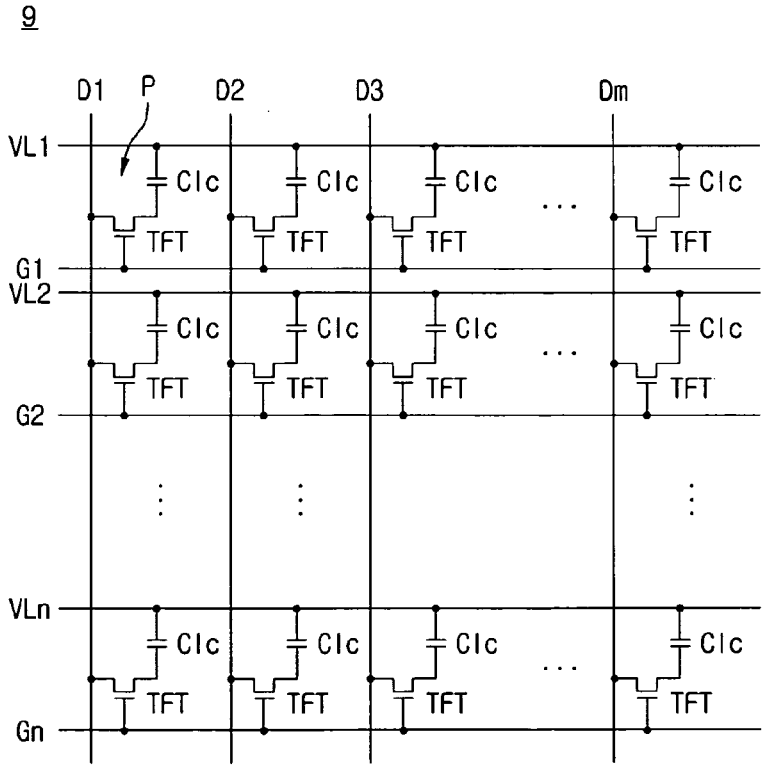
FIG. 2 is a circuit diagram illustrating a liquid crystal display panel of the LCD device of FIG. 1.
Figure 3:
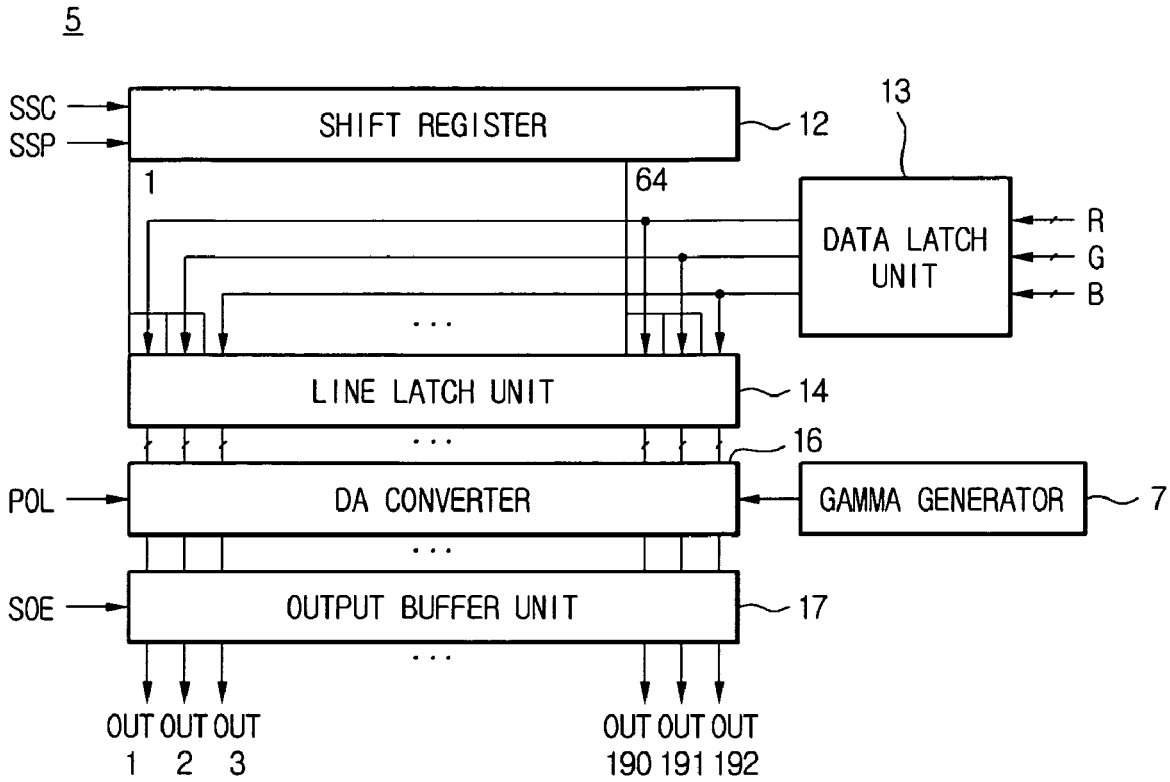
FIG. 3 is a block diagram illustrating a data driver of the LCD device of FIG. 1.
Figure 4:
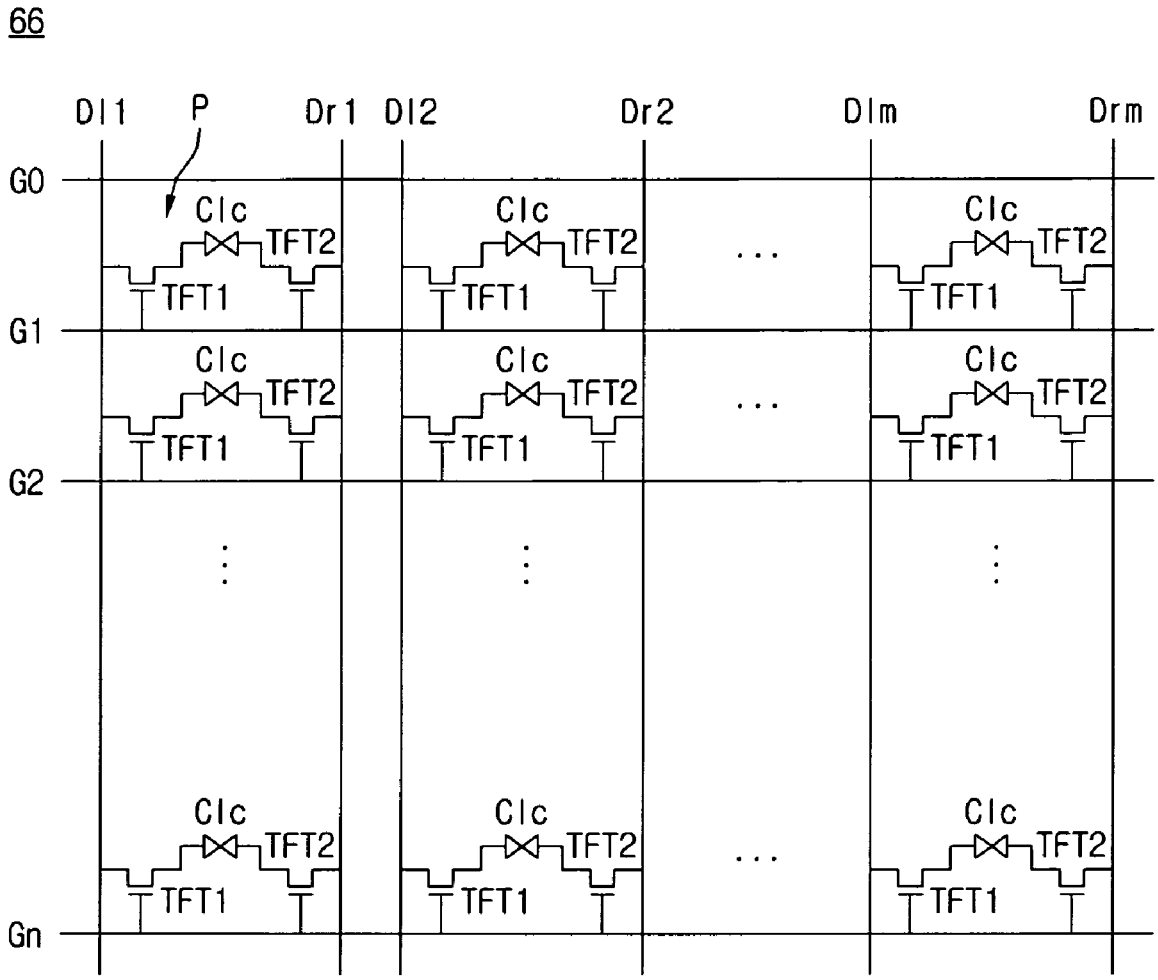
FIG. 4 is a circuit diagram illustrating a liquid crystal display panel according to an embodiment of the present invention.

FIG. 4 is a circuit diagram illustrating a liquid crystal display panel according to an embodiment of the present invention.

Referring to FIG. 4, a plurality of gate lines G1 to Gn, a plurality of first data lines Dl1 to Dlm, and a plurality of second data lines Dr1 to Drm are arranged on the liquid crystal display panel 9 such that the plurality of gate lines G1 to Gn cross the plurality of first and second data lines Dl1 to Dm and Dr1 to Drm. A plurality of pixels P are defined by crossings of the plurality of gate lines G1 to Gn with the pluralities of first and second data lines Dl1 to Dm and Dr1 to Drm. Therefore, a pixel P is defined by a crossing of a gate line G2 with a first data line Dl1 and a second data line Dr1. All of the pixels may be constructed in the manner described above.

More specifically, each pixel P includes a first thin film transistor TFT1 connected to the first data line Dl1, a second thin film transistor TFT2 connected to the gate line G2 and the second data line Dr1, a first pixel electrode connected to the first thin film transistor TFT1, a second pixel electrode connected to the second thin film transistor TFT2, and a liquid crystal cell Clc connected between the first and second pixel electrodes. Herein, the liquid crystal cell Clc denotes a capacitor formed by a liquid crystal layer existing between the first and second pixel electrodes.

In the first thin film transistor TFT1, a gate electrode is connected to the gate line G2, a source electrode is connected to the first data line Dl1, and a drain electrode is connected to the liquid crystal cell Clc. In the second thin film transistor TFT2, a gate electrode is connected to the gate line G2, a source electrode is connected to the second data line Dr1, and a drain electrode is connected to the liquid crystal cell Clc. Actually, the first pixel electrode is connected between the drain electrode of the first thin film transistor TFT1 and the liquid crystal cell Clc, and the second pixel electrode is connected between the drain electrode of the second thin film transistor TFT2 and the liquid crystal cell Clc. However, for the sake of illustrative convenience, the drain electrode of the first thin film transistor TFT1 and the drain electrode of the second thin film transistor TFT2 are illustrated as being directly connected to the liquid crystal cell Clc.

The respective gates of the first and second thin film transistors TFT1 and TFT2 are commonly connected to the same gate line G2 and the respective drains thereof are commonly connected to the liquid crystal cell Clc through corresponding pixel electrodes, whereas the source electrodes thereof are connected to the first and second data lines Dl1 and Drm, respectively.

The first and second thin film transistors TFT1 and TFT2 are simultaneously turned on by a scan signal applied to the gate line G2, and the liquid crystal cell Clc is driven by a potential difference, i.e., a voltage difference between the first and second data voltages supplied to the first and second data lines Dl1 and Dr1.

Although not shown, a storage capacitor Cst may be formed between a gate line G1 of an adjacent previous cell and a pixel electrode.

The scan signal, i.e., a gate high voltage Vgh, is sequentially supplied to each of the respective gate lines G1 to Gn for one horizontal period H, and a gate low voltage Vgl is then supplied after the lapse of one horizontal period H to a next frame.

When the scan signal, i.e., the gate high voltage Vgh, is supplied to a respective gate line G1 to Gn, the first and second thin film transistors TFT1 and TFT2 connected to the respective gate line G1 to Gn are simultaneously turned on.

First and second voltages may be applied to the first and second data lines Dl1 to Dm and Dr1 to Drm, respectively, wherein the first and second voltages are different from each other. The first voltage may be generated from the second data voltage or alternatively the second voltage may be generated from the first voltage. For example, when the first data voltage is generated from a positive polarity gamma voltage, the second data voltage may be generated from a negative polarity gamma voltage that is symmetric to the positive polarity gamma voltage with respect to a predetermined reference voltage Vref. Further, when the second data voltage is generated from the negative polarity gamma voltage, the first data voltage may be generated from a positive polarity gamma voltage that is symmetric to the negative polarity gamma voltage with respect to the predetermined reference voltage Vref.

By way of example, when the negative polarity gamma voltage is in a range of about 1V to about 8V, the positive polarity gamma voltage is in range of about 8V to about 15V, and the reference voltage Vref is 8V, the second data voltage may be selected as an 11V positive polarity gamma voltage to be symmetric to a 5V negative polarity gamma voltage first data voltage with respect to the 8V reference voltage Vref. In other words, the 5V negative polarity gamma voltage is lower than the 8V reference voltage Vref by 3V, and the 11V positive polarity gamma voltage is higher by 3V than the 8V reference voltage making the 5V negative polarity gamma voltage and the 11 volt positive polarity gamma voltage symmetric to each other with respect to the 8V reference voltage Vref. When one of the first and second data voltages, e.g., the first data voltage, is given, the other data voltage, e.g., the second data voltage may be easily generated using the above voltage symmetry relationship. The second data voltage when generated from the first data voltage may be referred to as a mirror voltage.

As shown in FIG. 4, the common line for supplying the common voltage in the liquid crystal display panel 66 may be omitted. When the common line is omitted because the common voltage is not used, circuitry for generating the common voltage may also be omitted. By omitting both the common line and the circuitry for generating the common voltage in the liquid crystal display panel according to an embodiment of the present invention, the fabrication process is simplified and fabrication cost can be reduced. In addition, by omitting the common line in the liquid crystal display panel according to the present invention, the aperture ratio can be improved because the common line does not occupy area in a pixel.

Furthermore, since the common voltage supplied through the common line may be omitted in a liquid crystal display panel according to the present invention, it is possible to reduce power consumption.

The first and second data voltages are supplied to the first and second data lines Dl1 to Dm and Dr1 to Drm of each pixel P so that the liquid crystal cell Clc is formed by a potential difference between the first and second data voltages. Therefore, the liquid crystal is driven by the potential difference between the first and second data voltages.

Accordingly, since the potential difference is determined by the first and second data voltages in the liquid crystal display panel 66 of the present invention, it is possible to generate higher potential differences than the potential difference between the common voltage and the data voltage in the relater art. Thus, the liquid crystal can be driven with high voltage and further high brightness image can be obtained.

By way of comparison, the liquid crystal is driven by the potential difference between the common voltage and the data voltage in the related art, whereas the liquid crystal is driven by potential difference between the symmetric first and second data voltages in the present invention.

For inversion driving, the first and second data lines Dl1 to Dm and Dr1 to Drm may be inverted in units of frames. For example, when the first data voltage based on the positive polarity gamma voltage is supplied to the first data line Dl1 to Dlm and the second data voltage based on the negative polarity gamma voltage is supplied to the second data line Dr1 to Drm during a first frame, the first data voltage based on the negative polarity gamma voltage may be supplied to the first data line Dl1 to Dlm and the second data voltage based on the positive polarity gamma voltage may be supplied to the second data line Dr1 to Drm during a next second frame.

A method for generating symmetric first and second data voltages will be more fully illustrated with reference to FIGS. 5 to 9 of the accompanying drawings.

Figure 5:
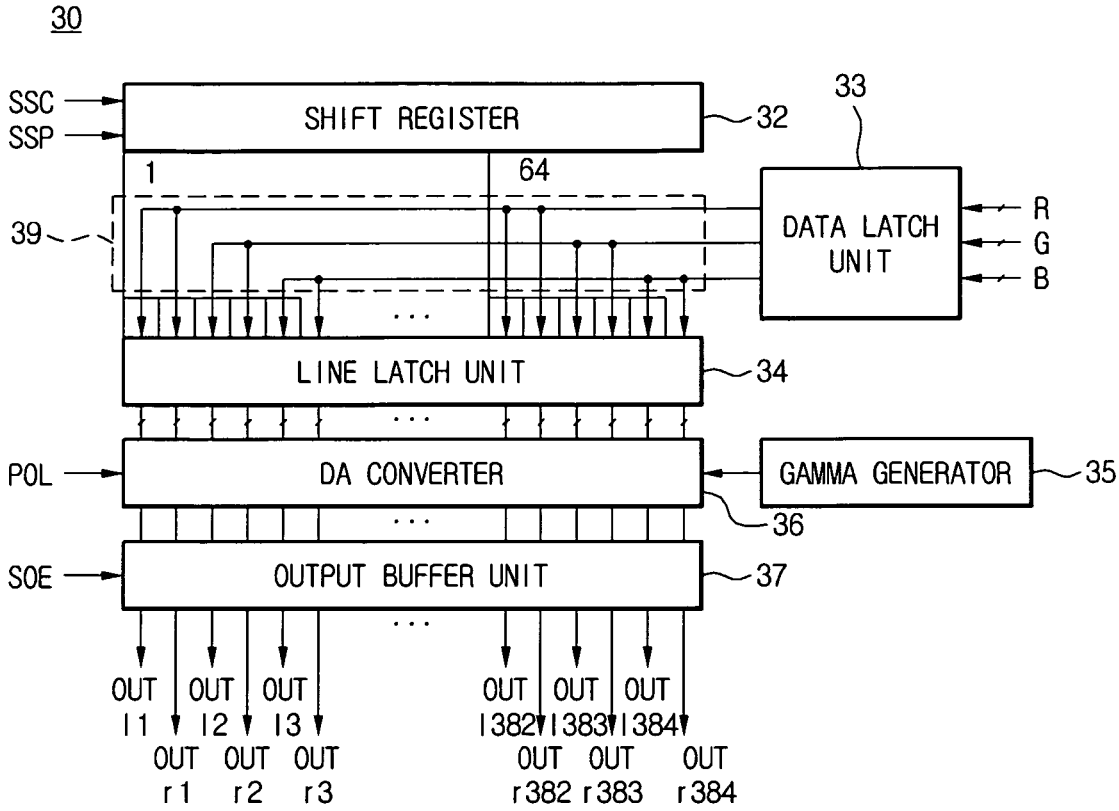
FIG. 5 is a block diagram of a data driver according to a first embodiment of the present invention for driving the liquid crystal display panel of FIG. 4.
Figure 6:
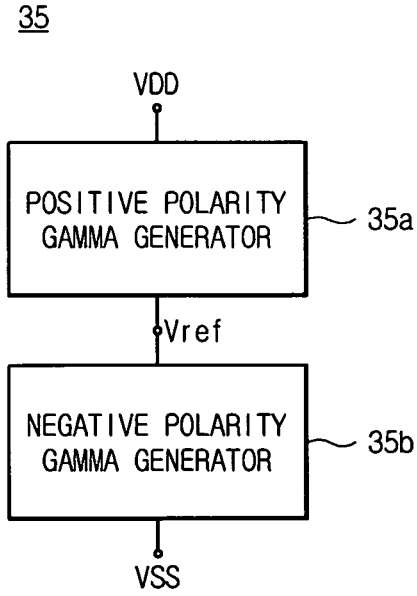
FIG. 6 is a block diagram illustrating a gamma generator of the data driver of FIG. 5.
Figure 7:
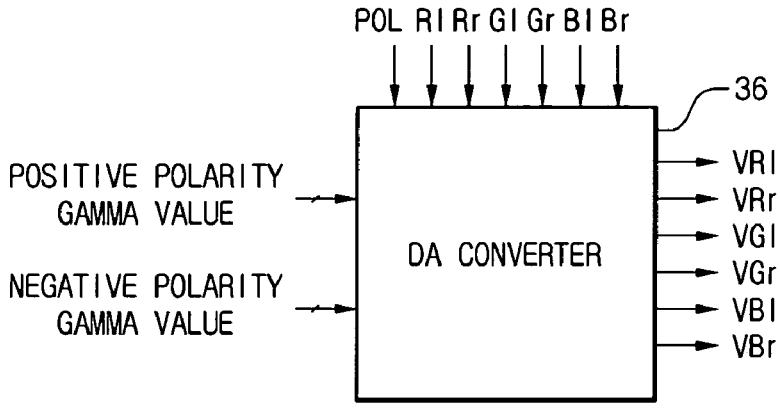
FIG. 7 is a schematic view illustrating a digital to analog (DA) converter of the data driver of FIG. 5.
Figure 8:
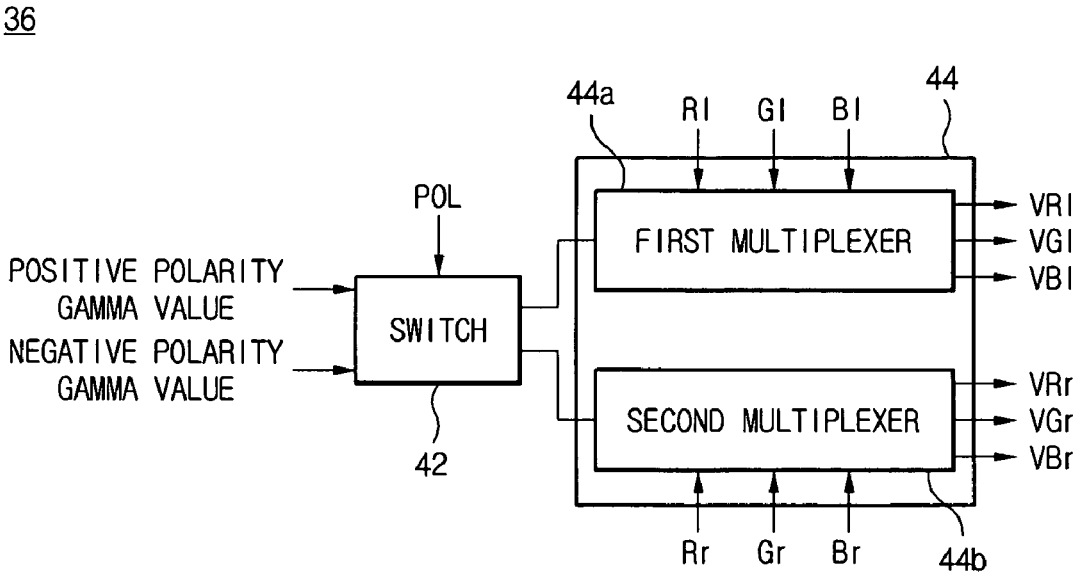
FIG. 8 is a block diagram illustrating the DA converter of FIG. 7 in detail.
Figure 9:
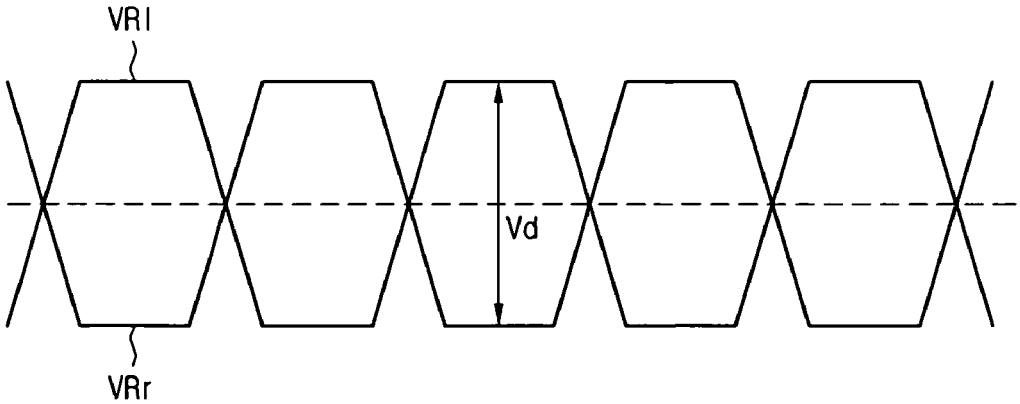
FIG. 9 is a waveform diagram illustrating a data voltage supplied from the data driver of FIG. 5.

FIG. 5 is a block diagram of a data driver according to a first embodiment of the present invention for driving the liquid crystal display panel of FIG. 4. FIG. 6 is a block diagram illustrating a gamma generator of the data driver of FIG. 5. FIG. 7 is a schematic view illustrating a digital to analog (DA) converter of the data driver of FIG. 5. FIG. 8 is a block diagram illustrating the DA converter of FIG. 7 in detail. FIG. 9 is a waveform diagram illustrating a data voltage supplied from the data driver of FIG. 5.

Referring to FIG. 5, the data driver 30 includes a data latch unit 33, a shift register 32, a line latch unit 34, a DA converter 36 and an output buffer unit 37.

The data driver 30 of FIG. 5 may include a single data driver IC. More generally, the data driver 30 may include a plurality of data driver ICs. For the sake of illustrative convenience, it is illustrated that the data driver 30 has one data driver IC in the present invention. When several data driver ICs are used, the respective data driver ICs are connected in parallel and the shift registers 32 included in the respective data driver ICs are cascade-connected. Accordingly, after an operation of a shift register included in a first data driver IC is completed, a shift register included in a second data driver IC starts operating. Through a sequence of such operations, the plurality of data driver ICs are controlled in cascade.

The data latch unit 33 latches n-bit R, G and B data signals in units of pixels.

The shift register 32 sequentially generates latch enable signals enabling the line latch unit 34 to latch the R, G and B data signals latched in the data latch unit 33 in synchronization with a SSC signal when a SSP signal is applied to the shift register 32.

The R, G and B data signals latched in the data latch unit 33 may be latched in the line latch unit 34 according to the latch enable signals.

In the data driver according to the illustrated embodiment of the present invention, however, the R, G and B data signals latched in the data latch unit 33 are not directly latched in the line latch unit 34 but are latched after they are divided into first and second data signals. That is, the R data signal is divided into first and second R data signals Rl and Rr, and the first and second R data signals Rl and Rr are then latched in the line latch unit 34. Likewise, the G data signal is divided into first and second G data signals Gl and Gr, and the first and second G data signals Gl and Gr are then latched. Also, the B data signal is divided into first and second B data signals Bl and Br, and the first and second B data signals Bl and Br are then latched. Thus, each of the R, G and B data signals may be divided into two data signals having the same data value, i.e., the first and second data signals Rl/Rr, Gl/Gr and Bl/Br, and then the divided two data signals are latched in the line latch unit 34. The divided first and second data signals, e.g., the first and second R data signals Rl and Rr, have the same data value as the original data signal before it is divided, e.g., the R data signal. For example, when the original data signal R is 001111, the first and second data signals Rl and Rr are also 001111.

The data driver 30 may further include a division unit 39 for dividing the R, G and B data signals into the first and second data signals Rl/Rr, Gl/Gr and Bl/Br, respectively. As illustrated in FIG. 5, the division unit 39 may be simply implemented by dividing one line into two lines each carrying the divided signals. Alternatively, the division unit 30 may be implemented as a separate circuit.

The first and second data signals divided from each of the R, G and B data signals are latched in the line latch unit 34 in response to the latch enable signal output from the shift register 32. Since the first and second data signals Rl/Rr, Gl/Gr and Bl/Br are divided from the R, G and B data signals, six first and second data signals Rl/Rr, Gl/Gr and Bl/Br are latched in the line latch unit 34 by one latch enable signal output from the shift register 32. Therefore, the first and second data signals Rl/Rr, Gl/Gr and Bl/Br are sequentially latched in sixes in the line latch unit 34 according to the respective latch enable signals. Through a sequence of operations as described above, the line latch unit 34 can latch the first and second data signals Rl/Rr, Gl/Gr and Bl/Br corresponding to one horizontal display line.

The DA converter 36 converts the first and second data signals Rl/Rr, Gl/Gr and Bl/Br latched at the line latch unit 34 into first and second data voltages corresponding to a gamma voltage supplied from the gamma generator 35. The DA converter 36 may generate the first and second data voltages using one of a positive polarity gamma voltage or a negative polarity gamma voltage supplied from the gamma generator 35.

Referring to FIG. 6, the gamma generator 35 includes a positive polarity gamma generator 35*a* and a negative polarity gamma generator 35*b*. The positive polarity gamma generator 35*a* generates a plurality of positive polarity gamma voltages between a first supply voltage VDD and a reference voltage Vref, and the negative polarity gamma generator 35*b* generates a plurality of negative polarity gamma voltages between the reference voltage Vref and a second supply voltage VSS. The gamma voltage is provided for converting a digital data signal to a corresponding analog signal, i.e., a data voltage, in the DA converter 36. The data voltages having different voltage levels are generated using voltage division between two voltages, for example, between the first supply voltage VDD and the reference voltage Vref, and between the reference voltage Vref and the second supply voltage VSS. Here, each voltage level represents a gamma voltage. The gamma voltage is supplied to the DA converter 36 and may be subdivided to correspond to each gray scale. Alternatively, the gamma voltage may be generated in the gamma generator 35 to correspond to each gray scale level. In the illustrated embodiment of the present invention, the gamma voltage generator 35 generates the gamma voltage corresponding to each gray scale. When the gray scale range is 0 to 255, the positive polarity gamma generator 35*a* generates 256 types of gamma voltages corresponding to respective gray scale levels, and the negative polarity gamma generator 35*b* generates 256 types of gamma voltages corresponding to respective gray scale levels.

The positive polarity gamma voltage and the negative polarity gamma voltage have voltage levels which are symmetric to each other with respect to the reference voltage Vref. For instance, it is assumed that the first supply voltage VDD, the reference voltage Vref and the second supply voltage VSS are 15V, 8V and 1V, respectively. When the gray scale is 125, the negative polarity gamma voltage of 4V is generated to be symmetric to a 12V positive polarity gamma voltage with respect to the 8V reference voltage Vref. Each of the positive and negative polarity gamma generators 35*a* and 35*b* can generate full gray scale, and the gamma voltages of the respective gamma generators 35*a* and 35*b* generate symmetric voltage levels with respect to the reference voltage Vref.

The DA converter 36 may include a switch 42 and a multiplexer 44, as shown in FIGS. 7 and 8.

The multiplexer 44 includes first and second multiplexers 44*a* and 44*b*. The first multiplexer 44*a* outputs first data voltages VRl, VGl and VBl corresponding to the first data signal Rl, Gl and Bl, and the second multiplexer 44*b* outputs second data voltages VRr, VGr and VBr corresponding to the second data signal Rr, Gr and Br.

The first multiplexer 44*a* selects the gamma voltage corresponding to the first data signal Rl, Gl and Bl among a plurality of the positive polarity gamma voltages or a plurality of negative polarity gamma voltages to output the selected gamma voltage as the first data voltage VRl, VGl and VBl. Likewise, the second multiplexer 44*b* selects the gamma voltage corresponding to the second data signal Rr, Gr and Br among a plurality of the positive polarity gamma voltages or a plurality of negative polarity gamma voltages to output the selected gamma voltage as the second data voltages VRr, VGr and VBr. The positive polarity gamma voltage is generated at the positive polarity gamma generator 35*a*, and the negative polarity gamma voltage is generated at the negative polarity gamma generator 35*b*.

The positive and negative polarity gamma voltages, which are supplied to the first and second multiplexers 44*a* and 44*b*, may be alternately supplied in units of dot, line or frame. Here, a dot refers to a pixel. As occasion demands, the pixel may be configured to include three dots.

For example, during the first frame, the positive polarity gamma voltage is supplied to the first multiplexer 44*a* and the negative polarity gamma voltage is supplied to the second multiplexer 44*b*. Thereafter, during the second frame, the negative polarity gamma voltage may be supplied to the first multiplexer 44*a* and the positive polarity gamma voltage may be supplied to the second multiplexer 44*b*.

In order to alternately supply the positive and negative polarity gamma voltages to the first and second multiplexers 44*a* and 44*b* in units of a dot, line or frame, the switch 42 is connected to a front end of the multiplexer 44. Therefore, the positive and negative polarity gamma voltages are switched in units of a dot, line or frame by the switch 42 in response to the POL signal, so that the positive and negative polarity gamma voltages can be alternately supplied to the first and second multiplexers 44*a* and 44*b*.

When the plurality of positive polarity gamma voltages are supplied to the first multiplexer 44*a* and the plurality of positive polarity gamma voltages are supplied to the second multiplexer 44*b*, the first multiplexer 44*a* selects the positive polarity gamma voltage corresponding to the first data signal Rl, Gl and Bl among the plurality of positive polarity gamma voltages to output the selected gamma voltage as the first data voltage VRl, VGl and VBl, and the second multiplexer 44*b* selects the gamma voltage corresponding to the second data signal Rr, Gr and Br among the plurality of negative polarity gamma voltages to output the selected gamma voltage as the second data voltages VRr, VGr and VBr. The first and second data voltages have voltage levels which are symmetric to each other with respect to the reference voltage Vref.

Consequently, DA converter 36 outputs the first and second data voltages VRl, VGl, VBl, VRr, VGr and VBr corresponding to the first and second data signals Rl, Gl, Bl, Rr, Gr and Br, using the positive and negative polarity gamma voltages.

In FIG. 5, the output buffer unit 37 outputs the first and second data voltages VRl, VGl, VBl, VRr, VGr and VBr output from the DA converter 36 to respective channels OUT 11 to OUT r384 in response to the POL signal. The number of channels may be correspondent to the number of the data lines Dl1 to Dlm and Dr1 to Drm of the liquid crystal display panel 66.

The first and second data voltages VRl, VGl, VBl, VRr, VGr and VBr are generated corresponding to the R, G and B data signals, and then the first and second data voltages VRl, VGl, VBl, VRr, VGr and VBr are supplied to the respective pixels of the liquid crystal display panel 66. For example, the first data voltage VRl, VGl and VBl may be supplied to the first data lines Dl1, Dl2, . . . , Dlm, and the second data voltage VRr, VGr and VBr may be supplied to the second data lines Dr1, Dr2, . . . , Drm.

The data driver 30 alternately inverts the first and second data voltage's VRl, VGl, VBl, VRr, VGr and VBr in units of dot, line, or frame based on the reference voltage Vref using the positive and negative polarity gamma voltages so that it is possible to obtain the waveform diagram of FIG. 9.

For example, during the first frame, the first data voltages VRl, VGl and VBl may be generated from the positive polarity gamma voltage, and the second data voltages VRr, VGr and VBr may be generated from the negative polarity gamma voltage. Thereafter, during the second frame, the first data voltages VRl, VGl and VBl may be generated from the negative polarity gamma voltage, and the second data voltages VRr, VGr and VBr may be generated from the positive polarity gamma voltage. By alternately using the positive and negative voltages at every frame, it is possible to generate the first and second data voltages VRl, VGl, VBl, VRr, VGr and VBr.

The liquid crystal corresponding to each pixel P of the liquid crystal display panel 66 is driven by the potential difference Vd, i.e., the voltage difference between first data voltages VRl, VGl and VBl and the second data voltages VRr, VGr and VBr generated at the data driver 30. Therefore, in comparison with the related art in which the liquid crystal is driven by the potential difference between the common voltage and the data voltage, the liquid crystal can be driven by the potential difference between first data voltages VRl, VGl and VBl and the second data voltages VRr, VGr and VBr which are generated using the reference voltage corresponding to the common voltage of the related art without the use of the common voltage. By supplying higher potential differences to the liquid crystal in comparison with the related art, it is possible to improve the image quality by increasing a response speed of the liquid crystal.

Figure 10:
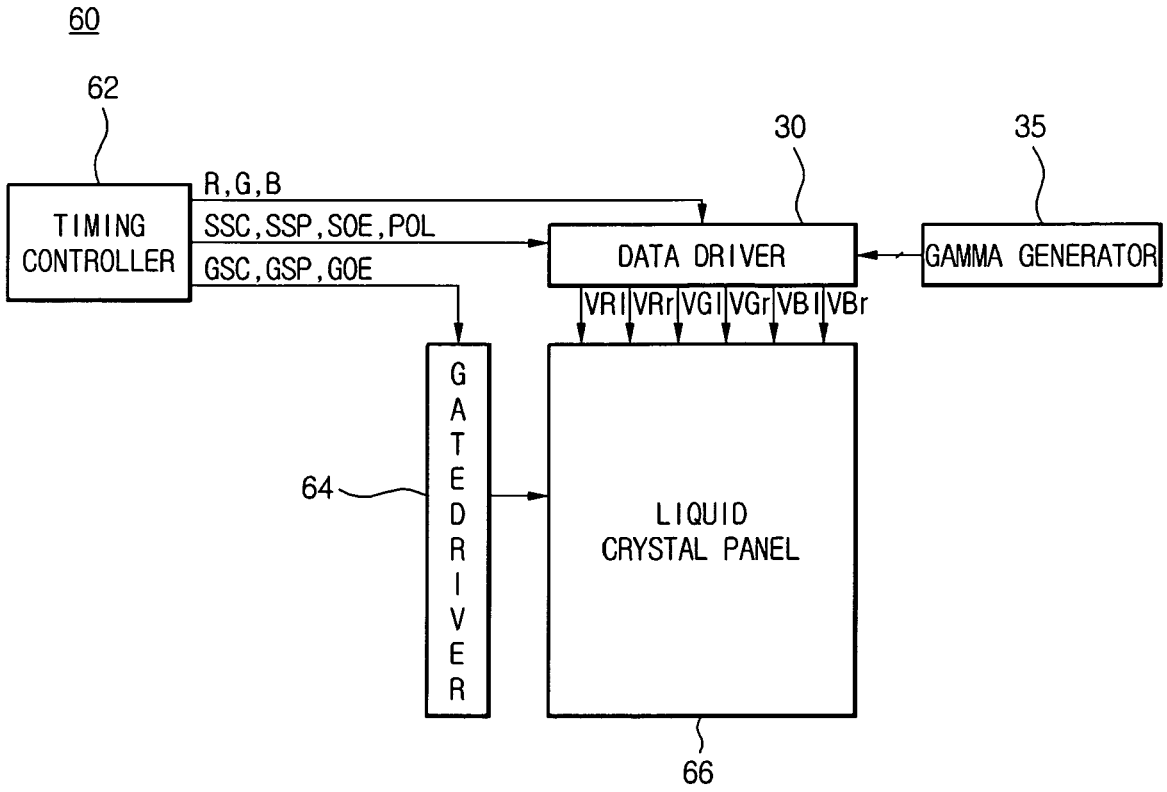
FIG. 10 is a block diagram of a liquid crystal display (LCD) device including the liquid crystal display panel of FIG. 4 and the data driver of FIG. 5.

FIG. 10 is a block diagram of a liquid crystal display (LCD) device including the liquid crystal display panel of FIG. 4 and the data driver of FIG. 5.

Referring to FIG. 10, an LCD device 60 includes a liquid crystal display panel 66, a gate driver 64 supplying a scan signal to the liquid crystal display panel 66, a data driver 30, and a timing controller 62 generating a control signal for controlling the gate driver 64 and the data driver 30. Herein, the liquid crystal display panel 66 includes a plurality of pixels arranged in a matrix, a plurality of gate line connected to the respective pixels, and first and second data lines crossing the gate lines. In addition, each pixel is configured with a first TFT connected to the gate line and the first data line, a second TFT connected to the gate line and the second data line, and a liquid cell connected therebetween. The data driver 30 generates first and second data voltages for R, G and B data signals using a gamma voltage, and supplies the first and second data voltage to the first and second data lines of the liquid crystal display panel 66.

The liquid crystal display panel 66 has the same configuration, operation as described above with reference to FIG. 4 and the data driver 30 has the same configuration, operation as described above with reference to FIG. 5 and a detailed description for these components will be omitted.

The timing controller 62 generates a control signal for driving the gate driver 64 ad the data driver 30 using image data and synchronization signal inputted from an external video card. The control signal includes a first control signal controlling the gate driver 64, and a second control signal controlling the data driver 30. The first control signal includes a gate shift clock (GSC), gate start pulse (GSP), and a gate output enable (GOE). The second control signal includes source shift clock (SSC), source start pulse (SSP), source output enable (SOE), and POL.

The gate driver 64 sequentially supplies the scan signals to the respective gate lines in response to the first control signal supplied from the timing controller 62. Accordingly, the respective gate lines of the liquid crystal display panel 66 are activated in sequence. That is, the first and second thin film transistors TFT1 and TFT2 of each pixel connected to the activated gate line are turned on. Thus, the first and second data voltages supplied from the data driver 30 can be supplied to respective pixel electrodes via the first and second thin film transistors TFT1 and TFT2 connected to the activated gate line.

The data driver 30 generates the first and second data voltages for the R, G and B data signals in response to the second control signal and then supplies the first and second data signals to the first and second data lines included in each pixel of the liquid crystal display panel 66.

The first and second data voltages have voltage levels which are symmetric to each other with respect to the reference voltage Vref. For instance, if the reference voltage Vref and the first data voltage are 8V and 6V, respectively, the second data voltage is 10V to be symmetric to the first data voltage with respect to the reference voltage.

When the first and second data voltages are supplied to the first and second data lines included in the respective pixels of the liquid crystal display panel 66 and the first and second thin film transistors TFT1 and TFT2 are turned on by the scan signal, the first and second data voltages are supplied to the first and second pixel electrodes connected to the first and second thin film transistors TFT1 and TFT2 via the first and second thin film transistors TFT1 and TFT2. Therefore, the liquid crystal of the pixel is be driven by the potential difference between the first and second data voltages.

Accordingly, since the LCD device 60 according to the illustrated embodiment of the present invention uses the liquid crystal display panel 66 in which the common line may be omitted, the fabrication process is simplified and fabrication cost can be reduced, and the aperture ratio may be improved.

In addition, the pixel of the liquid crystal display panel 66 has the first and second data lines in LCD device 60 according to an embodiment of the present invention, and has the data driver for supplying the first and second data voltages to the first and second data lines, which makes it possible to drive the liquid crystal by the potential difference between the first and second data voltages. Therefore, as the potential difference between the first and second data voltages is increased to thereby increase the response speed of the liquid crystal, the image quality is improved.

Meanwhile, the data driver 30 of FIG. 5 has a structure such that the R, G and B data signals output from the data latch unit 33 are divided into the first and second data signals and the divided data signals are then latched in the latch unit 34.

As described above, the R, G and B data signals may be divided at a front end of the line latch unit 34.

In the second embodiment of the present invention, the R, G and B data signals can be divided between the line latch unit and the DA converter 36.

Figure 11:
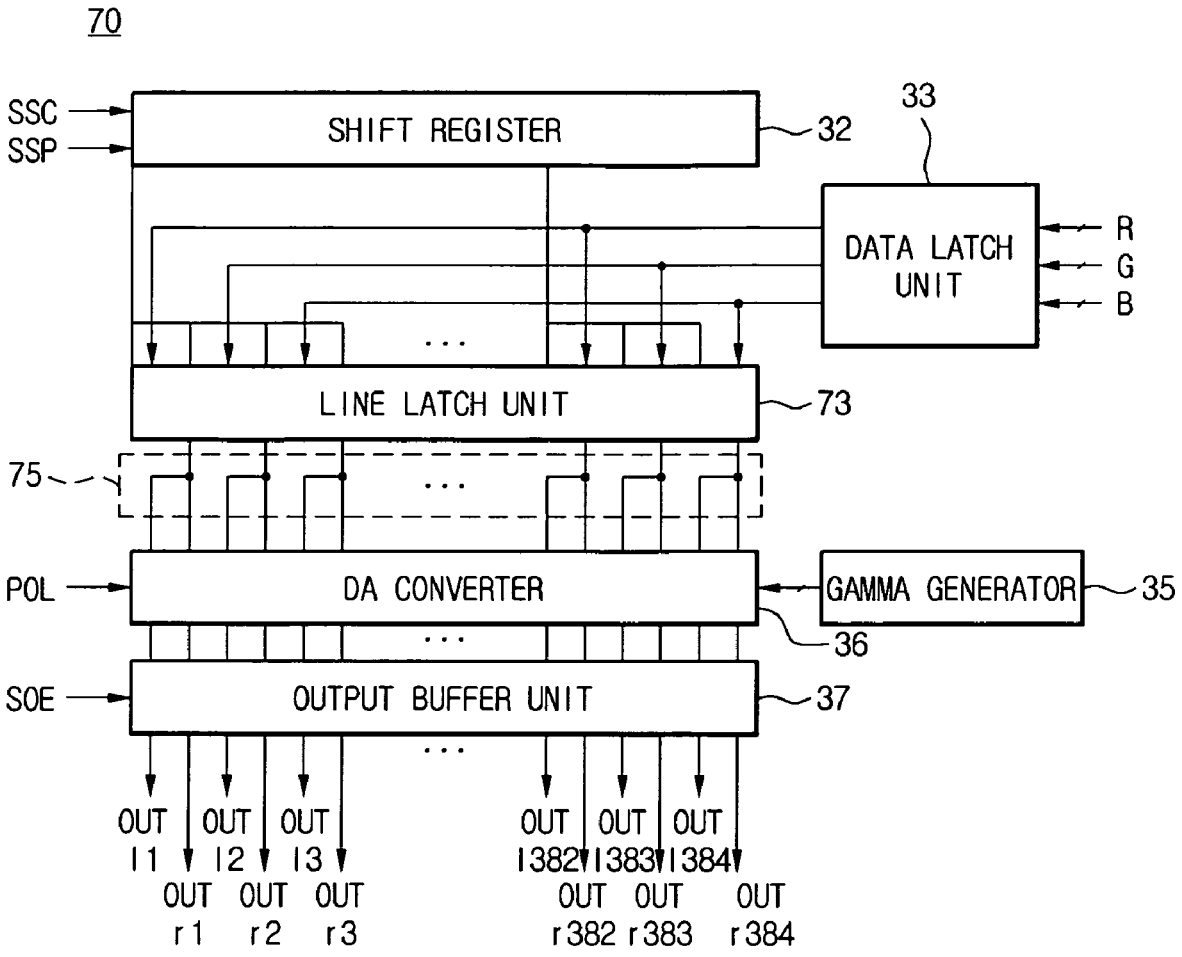
FIG. 11 is a block diagram of a data driver according to a second embodiment of the present invention for driving the liquid crystal display panel of FIG. 4.

FIG. 11 is a block diagram of a data driver according to a second embodiment of the present invention for driving the liquid crystal of FIG. 4.

Referring to FIG. 11, the data driver according to the second embodiment of the present invention has a similar structure as that shown in FIG. 5. That is, the data driver 70 according to the present invention includes a data latch unit 33, a shift register 32, a line latch unit 73, a DA converter 36 and an output buffer 37. Therefore, each element of the data driver 70 according to the second embodiment of the present invention has been illustrated in detail in FIG. 5 so that further descriptions will be omitted herein. However, the line latch unit 73 is somewhat different from that of FIG. 5, as will be more fully illustrated below.

In the data driver 70 according to the second embodiment of the present invention, the R, G and B data signals may be divided into first and second data signals between the line latch unit 73 and the DA converter 36. To this end, the data driver 70 may further include a division unit 75 between the line latch unit 73 and the DA converter 36.

The R, G and B data signals output from the line latch unit 73 are divided into the first and second data signals and thereafter the divided first and second data signals are supplied to the DA converter 36. The DA converter 36 outputs the first and second data voltages corresponding to the first and second data signals using the positive and negative polarity gamma voltages in the first and second multiplexers 44*a* and 44*b*, as illustrated in FIGS. 7 and 8.

The data driver 70 according to the second embodiment of the present invention divides the R, G and B data signals latched in the line latch unit 73 into the first and second data signals so that an occupation area of the line latch unit 73 is reduced to half of the line latch unit 34 of the data driver 30 of FIG. 5. As a result, it is possible to reduce fabrication cost and reduce occupation area of the circuitry.

As described above, according to embodiments the present invention, the liquid crystal display panel may omit the common line and circuitry for generating the common voltage to provide a simple fabrication process, low fabrication cost and improved aperture ratio.

According to embodiments of the present invention, since the pixel of the liquid crystal display panel includes the first and second data lines, and includes the data driver for supplying the first and second data voltages to the first and second data lines, the liquid crystal can be driven by the potential difference between the first and second data voltages. Therefore, the potential difference between the first and second data voltages can be increased, which makes it possible to improve the image quality as the response speed of the liquid crystal is increased due driving with higher potential differences.

According to an embodiment of the present invention, the R, G and B data may be divided after the R, G and B data are latched in the line latch unit so that the occupation area of the line latch unit and fabrication cost may be reduced.

Through use of embodiments of the present invention, by increasing the potential difference between the first and second data voltages for driving the liquid crystal display panel, it is possible to obtain high image brightness to increase display quality.

It will be apparent to those skilled in the art that various modifications and variations can be made in the present invention. Thus, it is intended that the present invention cover the modifications and variations of this invention provided they come within the scope of the appended claims and their equivalents.

What is claimed is:

1. A data driver for driving a liquid crystal display panel including a plurality of gate lines, a plurality of first data lines and a plurality of second data lines crossing the gate lines, and a plurality of pixels defined by crossings of a plurality of gate lines with a plurality of first data lines and a plurality of second data lines, wherein each of the pixels includes a first thin film transistor connected to a gate line and a first data line, a second thin film transistor connected to the gate line and the second data line, and a liquid crystal cell connected between the first and second thin film transistors, the data driver comprising:

a division unit that divides an input data signal into first and second data signals;

a shift register that sequentially outputs a latch enable signal;

a latch unit that latches the divided first and second data signals in response to the latch enable signal; and a digital to analog converter that outputs first and second data voltages corresponding to the first and second data signals using a plurality of positive polarity gamma voltages and a plurality of negative polarity gamma voltages, wherein a voltage level of each first data voltage is symmetric to that of a respective second data voltage with respect to a reference voltage, wherein the digital to analog converter includes:

a first multiplexer that outputs the first data voltage corresponding to the first data signal;

a second multiplexer that outputs the second data voltage corresponding to the second data signal; and a switch that alternately supplies the plurality of positive polarity gamma voltages and the plurality of negative polarity gamma voltages to the first and second multiplexers at every predetermined period.

2. The data driver according to claim 1, wherein the first and second data signals have a same data value.

3. The data driver according to claim 1, wherein the first and second data signals have a same data value as the input data signal undivided at the division unit.

4. The data driver according to claim 1, wherein voltage levels of the plurality of positive polarity gamma voltages are symmetric to respective voltage levels of the plurality of negative polarity gamma voltages with respect to the reference voltage.

5. The data driver according to claim 1, wherein the predetermined period is one of a dot unit, a line unit and a frame unit.

6. The data driver according to claim 1, wherein the first multiplexer selects one of a gamma voltage corresponding to the first data signal among the plurality of positive polarity gamma voltages and the plurality of negative polarity gamma voltages to output the selected gamma voltage as the first data voltage.

7. The data driver according to claim 1, wherein the second multiplexer selects one of gamma voltage corresponding to the second data signal among the plurality of positive polarity gamma voltages and the plurality of negative polarity gamma voltages to output the selected gamma voltage as the second data voltage.

8. A data driver for driving a liquid crystal display panel including a plurality of gate lines, a plurality of first data lines and a plurality of second data lines crossing the gate lines, and a plurality of pixels defined by crossings of a plurality of gate lines with a plurality of first data lines and a plurality of second data lines, wherein each of the pixels includes a first thin film transistor connected to a gate line and the first data line, a second thin film transistor connected to the gate line and the second data line, and a liquid crystal cell connected between the first and second thin film transistors, the data driver comprising:

a shift register that sequentially outputs a latch enable signal;

a latch unit that latches an input data signal in response to the latch enable signal;

a division unit that divides the input data signal into first and second data signals; and a digital to analog converter that outputs first and second data voltages corresponding to the first and second data signals using a plurality of positive polarity gamma voltages and a plurality of negative polarity gamma voltages, wherein a voltage level of each first data voltage is symmetric to a voltage level of the respective second data voltage with respect to a reference voltage, wherein the digital to analog converter includes:

a first multiplexer that outputs the first data voltage corresponding to the first data signal;

a second multiplexer that outputs the second data voltage corresponding to the second data signal; and a switch for alternately supplying the plurality of positive polarity gamma voltages and the plurality of negative polarity gamma voltages to the first and second multiplexers at every predetermined period.

9. The data driver according to claim 8, wherein the first and second data signals have the same data value.

10. The data driver according to claim 8, wherein the first and second data signals have the same data value as the input data signal undivided at the division unit.

11. The data driver according to claim 8, wherein the predetermined period is one of a dot unit, a line unit and a frame unit.

12. The data driver according to claim 8, wherein the first multiplexer selects one of a gamma voltage corresponding to the first data signal among the plurality of positive polarity gamma voltages and the plurality of negative polarity gamma voltages to output the selected gamma voltage as the first data voltage.

13. The data driver according to claim 8, wherein the second multiplexer selects one of a gamma voltage corresponding to the second data signal among the plurality of positive polarity gamma voltages and the plurality of negative polarity gamma voltages to output the selected gamma voltage as the second data voltage.

14. A liquid crystal display device comprising:

a liquid crystal display panel including a plurality of pixels arranged in a matrix, wherein each pixel is defined by an crossing of a gate line with a first data line and a second data line;

a gate driver supplying a scan signal that activates the gate line; and a data driver that supplies first and second data voltages to the first and second data lines using first and second data signals, wherein the first and second data voltage are different from each other, a voltage level of the first data voltage being symmetric to that of the second data voltage with respect to a reference voltage, a digital to analog converter comprising:

a first multiplexer that outputs the first data voltage corresponding to the first data signal;

a second multiplexer that outputs the second data voltage corresponding to the second data signal; and a switch for alternately supplying the plurality of positive polarity gamma voltages and the plurality of negative polarity gamma voltages to the first and second multiplexers at every predetermined period.

15. The liquid crystal display device according to claim 14, wherein the first and second data signals have a same data value.

16. The liquid crystal display device according to claim 14, wherein the first and second data signals have a same data value as an undivided input data signal.

17. The liquid crystal display device according to claim 14, wherein the predetermined period is one of a dot unit, a line unit and a frame unit.

18. The liquid crystal display device according to claim 14, wherein the first multiplexer selects one of a gamma voltage corresponding to the first data signal among the plurality of positive polarity gamma voltages and the plurality of negative polarity gamma voltages to output the selected gamma voltage as the first data voltage.

19. The liquid crystal display device according to claim 14, wherein the second multiplexer selects one of a gamma voltage corresponding to the second data signal among the plurality of positive polarity gamma voltages and the plurality of negative polarity gamma voltages to output the selected gamma voltage as the second data voltage.

20. A method of driving a liquid crystal display device including a driving unit for driving a liquid crystal display panel having a plurality of pixels arranged in a matrix, wherein each pixel is defined by an crossing of a gate line with a first data line and a second data line, the method comprising:

supplying a scan signal for activating the gate line;

supplying first and second data voltages to the first and second data lines, wherein the first and second data voltage are different from each other;

displaying an image on the liquid crystal display panel using potential difference between the first and second data voltages, wherein a voltage level of the first data voltage is symmetric to that of the second data voltage with respect to a reference voltage, wherein the supplying of the first and second data voltages includes:

dividing an input data signal into the first and second data signals; and outputting the first and second data voltages corresponding to the first and second data signals using a plurality of positive polarity gamma voltages and a plurality of negative polarity gamma voltages, wherein the step of outputting the first and second data voltages includes, outputting the first data voltage corresponding to the first data signal by a first multiplexer of a digital to analog converter;

outputting the second data voltage corresponding to the second data signal by a second multiplexer of the digital to analog converter.

21. The method according to claim 20, wherein the first and second data voltages are generated from an input data signal.

22. The method according to claim 20, wherein the first and second data signals have a same data value.

23. The method according to claim 20, wherein the first and second data signals have a same data value as the input data signal.

* * * * *